US005772157A

United States Patent [19]

Lauck et al.

[11] Patent Number: 5,772,157

[45] Date of Patent: Jun. 30, 1998

[54] OPERATING RAILROAD SWITCHES

[75] Inventors: Robert B. Lauck, San Juan Capistrano; Joachim G. Bush, Burbank, both of Calif.

[73] Assignee: Fluid Energy Controls, Inc., Los Angeles, Calif.

[21] Appl. No.: 797,561

[22] Filed: Feb. 7, 1997

[51] Int. Cl.[6] ..... B61L 5/04

[52] U.S. Cl. ..... 246/257; 246/258; 246/393

[58] Field of Search ..... 246/257, 258, 246/393, 407

[56] References Cited

U.S. PATENT DOCUMENTS 3,015,464 1/1962 Bush ..... 246/258

4,428,552 1/1984 Frank et al. ..... 246/393

5,375,796 12/1994 Turner et al. ..... 246/257

5,417,392 5/1995 Wyatt ..... 246/257

*Primary Examiner*—S. Joseph Morano

*Attorney, Agent, or Firm*—Frederick Gotha

[57] ABSTRACT

The railroad power switch operates from the energy stored in a hydraulic accumulator. A pump charges the accumulator and keeps it charged. A power cylinder acts on the moveable rail of a railroad switch through this hydraulic energy. The energy opens the switch, closes it, and stabilizes it during train trailing through the switch. A spring pack supplements this hydraulic energy in stabilizing the switch.

17 Claims, 5 Drawing Sheets

150
CLOSED
(SWITCH BACK)
13
177
175
179
30
29
28
185
16
18
32
182

181
29
28
30
16
18
177
32

29
28
30
16
141
32

177
185
30
29
16
OPEN
(SWITCH AWAY)
32

OPERATING RAILROAD SWITCHES

FIELD OF THE INVENTION

The present invention relates in general to railroad yard switches, and, in particular, to a improved hydraulically operated railroad yard switch.

BACKGROUND OF THE INVENTION

Previously, yard switches, for rail car assembly or hump yards were usually pneumatically or electrically powered. Manual override of either type of switch is usually possible with an over center cam arrangement.

In a pneumatic system, the over center cam and the compressibility of air in a biasing pneumatic spring permits safe trailing through the switch(s). A problem with pneumatically powered switches is that air leaks create a major demand for air capacity from a central air source. A second problem is moisture in the air. The moisture can condense and freeze. The condensation can cause corrosion. Freezing can result in switch seizure and lockup.

Electrical systems are good, but they too have problems. Among the problems are excessive power consumption and power drain during standby. The excessive power consumption results from a lack of an acceptable means to store power during stand-by.

Hydraulic systems are also good, but have tended to be large and expensive. They are good because of reliability.

In any switching system a number of criteria should be met. There should be a correct rail load between the moveable and stationary rails of a switch. Electric load should be low. Wear should be at a minimum. In addition, there must be a mechanism to sense rail shift completion.

SUMMARY OF THE INVENTION

The present invention provides an improved railroad switch characterized by a simple and reliable hydraulic circuit that satisfies these criteria.

Briefly, the present invention contemplates accumulator means for storing hydraulic fluid under pressure and means for charging the accumulator with pressurized hydraulic fluid. We provide means, such as a pump, for charging the accumulator with hydraulic fluid. Means in the accumulator maintain the charged hydraulic pressure. Such means may be a bladder and pressurized gas. A hydraulic cylinder has a switch reverse chamber, and a switch forward chamber which are separated by a piston. The reverse chamber correlates to the railroad switch in a closed position. The forward chamber correlates to the railroad switch in an open position. Both chambers see accumulator pressure during their respective portions of switch operation. The piston acts on linkage means to the moveable rails of a railroad yard switch. Means is provided to admit hydraulic fluid to the forward chamber and to open the railroad switch. Means is also provided to admit hydraulic fluid to the reverse chamber and to close the railroad switch.

In the presently preferred form of our invention, the hydraulic cylinder preferably has a biasing spring pack that may alternatively act on the piston to positively urge it towards either a normal or reverse chamber. In greater detail, the spring pack includes a compression spring received in a mounting plate, and a pair of retainers at each end of the spring, to confine it. An interior shoulder on the outside of the power cylinder engages one of the retainers. The other retainer engages an interior shoulder of the receiving mounting plate. Forces from the moving rail of a switch act through the power piston on the cylinder, and the cylinder in turn acts on the retainer proximate the application point of the load to compress the spring towards its distal end. This resistance by the spring pack exists in either of the railroad switches positions.

The cylinder has travel greater than the track movement during switching. This additional travel results in the spring pack's compression. With the compression of the spring pack, a proper track point load always exists. When a train trails through the switch, the spring compresses further protecting against derailment and switch abuse and wear.

Means in the preferred form of the invention make sure the switch is always tight. We take advantage of the fact that hydraulic fluid is incompressible. We use pressure sensitive switches to sense any leakage as a major drop in pressure through reverse and normal pressures switches that sense any leakage as a major drop in pressure. The control system responds to these signals to reestablish proper rail load. This response is preferably through solenoid valves of the hydraulic circuit. These solenoid valves communicate the accumulator with the chambers of the cylinder at the appropriate times in switch operation. We provide leak proof components to reduce the use of power during standby.

Once the railroad switch has reached its proper position, either open (away) or closed (back), there is no need for electrical current to energize the system's solenoids, and the switch will hold its position and load indefinitely. The hydraulic fluid under pressure in the hydraulic cylinder is in a leak proof environment because we choose resilient seals in the check valves and cylinder of our hydraulic circuit.

The electric motor driven pump charges (fills) the accumulator. When the accumulator is charged, a large volume of fluid is always available to rapidly shift the railroad switch. This allows the switch to be ready at all times to respond to switching requirements. The near zero leak components used on the pump side of our circuit minimize the electrical energy required to keep the switch in a standby mode.

The shift speed requirements are met by the energy stored in the accumulator. The size of the pump and the electrical power requirements of the motor are small since recharging times are not critical.

Preferably, a hand pump provides a way to charge the accumulator in the event of electrical power loss. The pump can also be used to operate the switch while aligning the hardware on initial lash up. The hand pump requires only light manual loads and, consequently, back injuries are unlikely.

We preferably provide manual override of the solenoid valves for manual operation or to unload the accumulator for safety.

These and other features, aspects, and advantages of the present invention will become more apparent from the following detailed description, drawings, and appended claims.

DETAILED DESCRIPTION OF THE PRESENTLY PREFERRED EMBODIMENT

Figure 1:
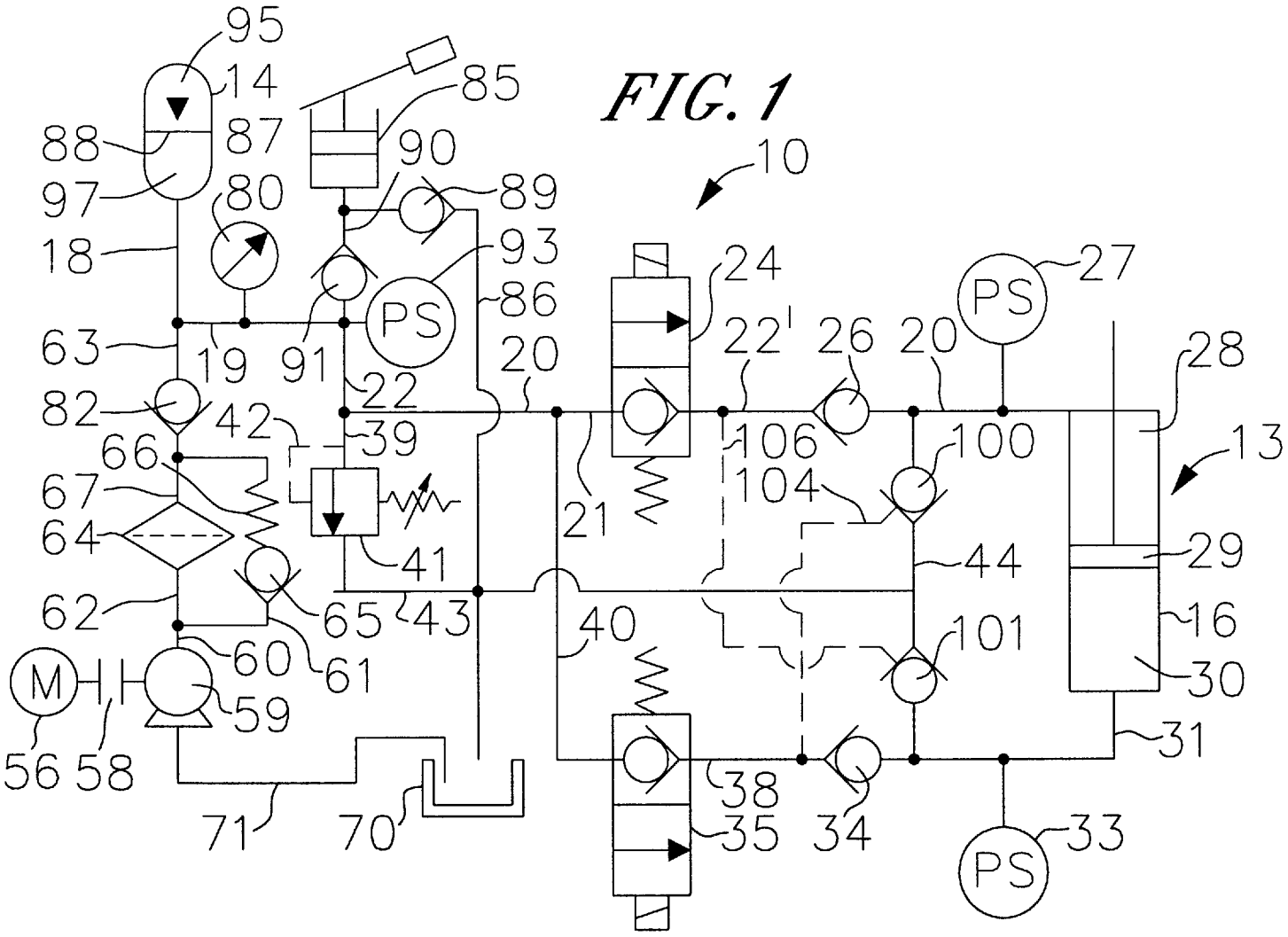
FIG. 1 is a schematic diagram of the hydraulic circuit of our invention.
Figure 2:
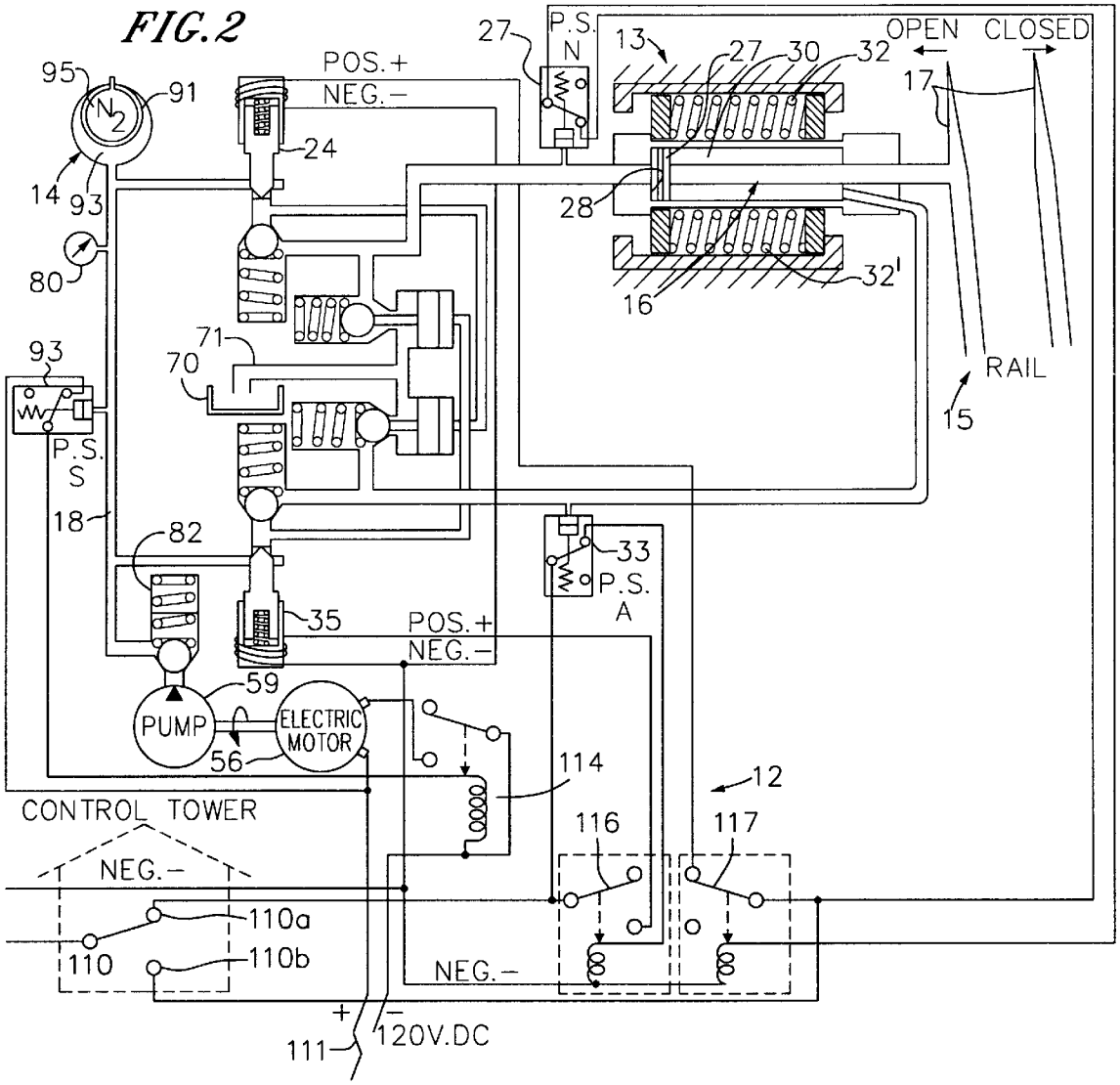
FIG. 2 is a schematic diagram of the electrical circuit of our invention showing cooperation with hydraulic circuit components of our invention.

With reference to FIGS. 1 and 2, the preferred embodiment of the present invention has a hydraulic circuit 10 and a complementary electrical circuit 12.

With specific reference to FIG. 1, hydraulic circuit 10 includes an accumulator 14 and a spring pack or hydraulic cylinder assembly 13. The hydraulic cylinder operates a railroad track switch 15 (see FIG. 2) in a manner which we will describe subsequently. The switch has moveable rails 17.

Cylinder assembly 13 has a cylinder 16. The cylinder has a normal (switch back) chamber 28 and a reverse (switch away) chamber 30. A piston 29 separates the two chambers, and sees the pressures in both of them.

The accumulator is in a series hydraulic circuit with back chamber 28 of cylinder 16 through a series of lines 18, 19, 22, 20, 21, 22' and 23.

A normally closed solenoid valve 24 is in circuit with cylinder 16 through lines 22' and 23. This valve functions to reverse the railroad switch or move it to the back position, and to keep the rail contact tight.

During activation of solenoid 24, pressure in line 106 will open pilot operated check valve 101 allowing the fluid in cylinder chamber 30 to evacuate out line 31 through check valve 101 and through line 44 to reservoir 70.

A check valve 26 between lines 22' and 23 prevents back flow from cylinder 16 from leaking out by the pilot operated piston on check valve 101. A normally closed reverse chamber pressure switch 27 in line 23 is between the check valve and reverse chamber 28 of cylinder 16, and controls the pressure in that chamber, as will become apparent from the discussion of FIG. 2.

Chamber 28 of cylinder 16 communicates to accumulator 14 through lines 18, 19, 22, 20, 22' and 23. A line 31 from chamber 30 communicates with a normally closed solenoid valve 35.

Upon energizing, solenoid 35 moves to the normal position resulting in further compression of springs 32 and 32' to assure strong point closure or desirable rail contact.

As can be seen in FIG. 2, biasing springs 32 and 32' associated with cylinder assembly 13 act to stabilize the moveable rail in a manner we will later particularly describe with reference to subsequent Figures (especially FIG. 5). A normally closed normal or away chamber pressure switch 33 in line 31 sees pressure in the reverse side chamber, and controls pressure in cylinder chamber 28 to the desired level. Upon activation of solenoid valve 35, the pressure build up in lines 38 and 104 will unseat pilot operated check valve 100 allowing fluid in cylinder chamber 28 to evacuate through lines 23 to 44 to reservoir 70. A check valve 34 between line 31 and a line 38 prevents back flow from chamber 30 through line 104 to leak past the pilot piston in pilot operated valve 100.

Line 20 joins a line 39, which is in series hydraulic circuit with a normally closed adjustable relief valve 41. Line 39 joins line 22 from the accumulator.

The relief valve has a pilot line 42 to open it. The pilot line sees the pressure in line 39 (accumulator pressure). The relief valve opens when accumulator pressure in line 39 overcomes the resistance of the relief valve's biasing spring. The relief valve discharges into a line 43. Line 43 tees into a line 44.

We use leak proof solenoid and check valves to reduce the amount of power required to keep the accumulator charged during standby.

An electric motor 56 through a coupling 58 drives pump 59. Pump 59 discharges into a line 60. Line 60 branches into two parallel lines 61 and 62. Line 62 goes to a filter 64. Filter 64 discharges into a line 67. A check valve 65 in line 61 permits bypassing of the filter when the pressure in line 62 is sufficiently high to overcome the resistance of a spring 66 of valve 65 that biases the valve closed. Line 61 joins line 67 down stream from filter 64. Pump 59 draws its hydraulic fluid from a reservoir 70 through a line 71.

Line 18 branches into lines 19 and 63. A pressure gauge 80 in line 19 monitors the hydraulic pressure in the accumulator. A check valve 82 in line 62 prevents fluid from the accumulator from going towards the filter and leaking by the pump.

A hand pump 85 provides a backup for motor 56 in the event of an interruption in electric power. A line 86 from reservoir 70 tees into a line 87 to this pump, and supplies hydraulic fluid to it. A check valve 89 in line 86 prevents back flow from the hand pump to the reservoir.

The hand pump parallels the accumulator and the motor driven pump. Hand pump 85 discharges into line 87. Line 87 joins a line 90 upstream of a check valve 91 in line 90. Check valve 91 prevents flow from the accumulator into the hand pump. Line 90 joins lines 19 and 22.

Accumulator 14 can be of a piston or bladder type. As illustrated, it has a bladder 88 that separates its interior into two volumes 95 and 97 for pressurizing nitrogen and hydraulic fluid, respectively. The nitrogen is under pressure and through the bladder applies pressure to hydraulic fluid in volume 97.

An accumulator pressure switch 93 in line 22 sees accumulator pressure. Its function will become more apparent from the discussion attending FIG. 2.

With reference to FIG. 2, electrical circuit 12 has a relay with switch 110 to provide power to the solenoid valves of the hydraulic circuit.

Switch 110 has two poles 110*a* and 110*b*.

Pole 110*a* of switch 110 is in series with the contacts of a relay 116; it is also in series with pressure switch 33. Pressure switch 33 and the contacts of relay 116 are in parallel. The contacts in turn are in series with the positive side of the coil of reverse/back solenoid 35.

Pole 110*b* is in series with the contacts of a normally open relay 117, and through these contacts with the positive side of the coil of normal or away solenoid 24. The coil of relay 117 is in series with normally closed normal pressure switch 27. When the pressure sensed by normal pressure switch 27 is sufficiently high, it opens dropping relay 117 out of circuit.

The negative side of the power source is wired to the coils of relays 116 and 117, normal pressure switch 27, and the negative sides of the coils of solenoids 24 and 35. The coils of these two relays are in parallel. The coil of relay 116 is in series with normal pressure switch 27.

Briefly, with switch 110 in the position shown the armature of switch 110 contacts pole 110*a*. Reverse pressure switch 33 is closed if the pressure in reverse chamber 30 is low enough, and there is a circuit through switch 33 to the coil of relay 116. The contacts of this relay, therefore, are closed. Since these contacts are closed, reverse solenoid 35 is energized, and hydraulic fluid from the accumulator passes through the valve into reverse chamber 30 to move railroad switch 15 to the reverse or back position, as shown in FIG. 2. When the pressure in that chamber indicates that railroad switch 15 is fully open, pressure switch 33 opens dropping relay 116 out of circuit. This in turn drops solenoid valve 35 out of circuit and it closes.

With alternate pole 110*b* in circuit (the normal or away condition) current through the contacts of relay 117 energizes the coil of normal solenoid 24 communicating the accumulator with normal chamber 28 to move railroad switch 15 to the away position.

The polarity of solenoid valves 24 and 35 reverse with the change of the position of the armature of switch 110.

Electric power is supplied externally to electric motor 56 through a normally open motor relay 114. The contacts of this relay are in parallel with the relay's coil and normally closed accumulator pressure sensing switch 93. The coil of the motor relay is in series with accumulator pressure switch 93. When the pressure in accumulator is at operational level, switch 93 opens dropping relay 114 and motor 56 out of circuit.

When power is supplied from external switch 110 through contact 110*b,* the contacts of relay 117 close, normal solenoid valve 24 opens, and hydraulic fluid can flow into away chamber 28 of cylinder 16.

When pressure sensed by reverse pressure switch 27 is sufficiently high, it opens, dropping relay 117 out of circuit. This causes the contacts to open, valve 24 to close which locks the fluid in chamber 28.

Figure 3:
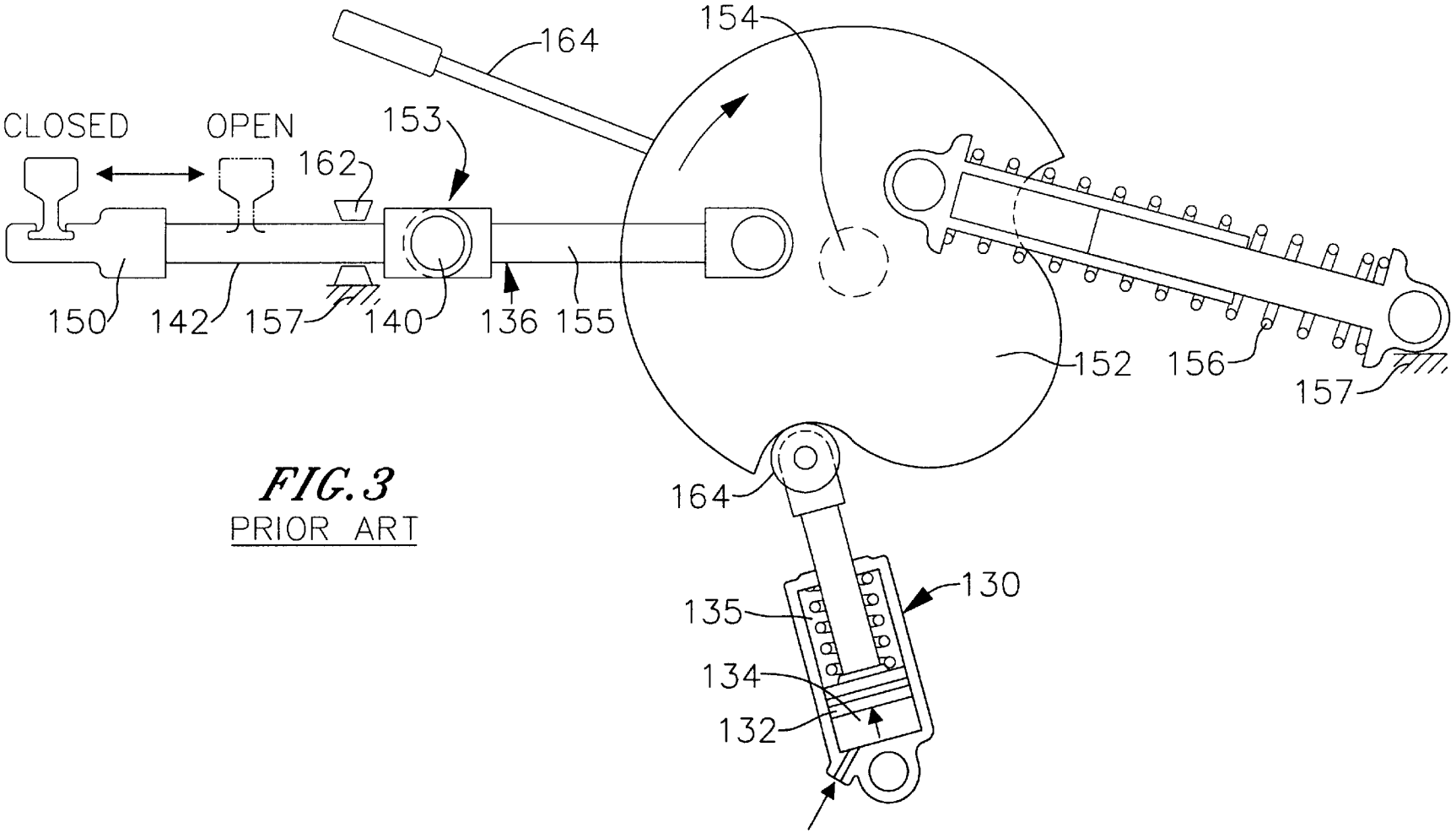
FIG. 3 PRIOR ART
FIG. 3 is a schematic view of a prior art railroad over center cam arrangement that is preferably used with this invention.
Figure 4:
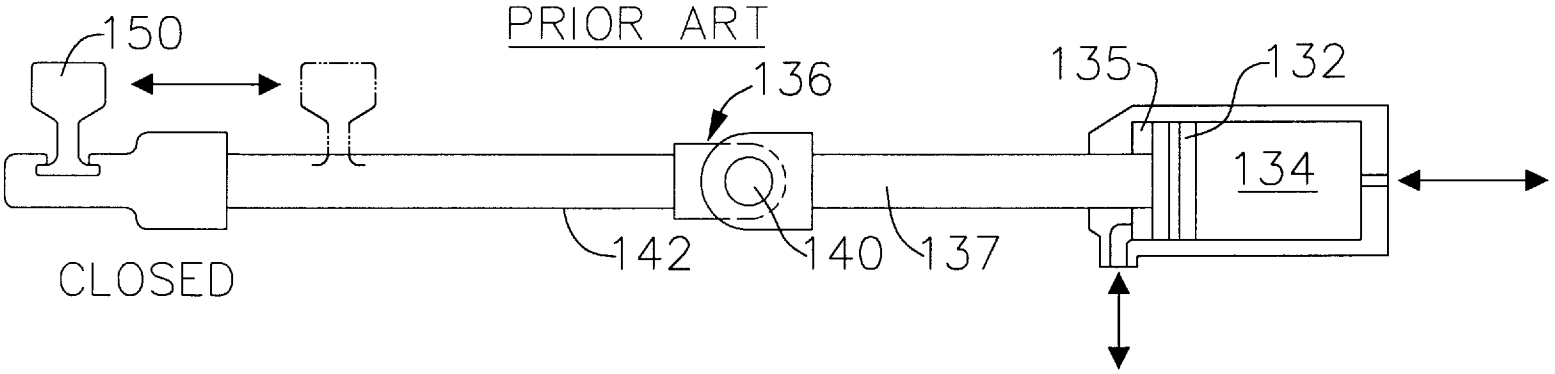
FIG. 4 PRIOR ART
FIG. 4 is a schematic view, in partial half-section, of a known pneumatic switch that shows the linkage the present invention uses.

With reference to FIGS. 3 and 4, we illustrate a prior art pneumatically operated cylinder and linkage. Here, a pneumatic cylinder 130 has a piston 132 acted upon by air pressure in a normal chamber 134 and a reverse chamber 135. A linkage 136 attaches to the piston through a shaft 137, a U-joint 140 and a rod 142. The rod engages moveable rails 150 of a railroad switch, like the moveable rails of switch 15 of FIG. 2. The double-headed arrow in FIG. 4 shows movement of the moveable rails.

When air under pressure enters chamber 135, the piston translates down in FIG. 3 (and to the right in FIG. 4). When it does it opens the switch, as indicated.

When air under pressure enters normal chamber 134, the piston translates in the opposite direction to close the switch.

With specific reference to FIG. 3, we adapt the manual operation of this switch to our invention as a back-up. The switch has a cam 152 mounted on a shaft 154. An over center spring 156 acts between the cam 152 mounted on a shaft 154. An over center spring 156 acts between the cam and ground, indicated by reference numeral 157. A link 155 between the cam and shaft 142 transmits cam rotation as linear travel for movement of the moveable rails. A pillow block 162 guides shaft 142. Pneumatic cylinder 110 can cat on the cam through a follower 164. In either case, rotation of the cam counter clockwise in the Figure moves the moveable rail to the left and into the switch closed position. Rotation of the cam in the clockwise direction opens the switch. A handle 164 permits manual operation.

Condensation in the cylinder can corrode it resulting in unsatisfactory action of the piston. Worse, the condensation can freeze to seize the piston and lock up the switch. Air leakage by seals or due to corrosion problems cause large power losses to maintain adequate pressure for proper operation.

Figure 5:
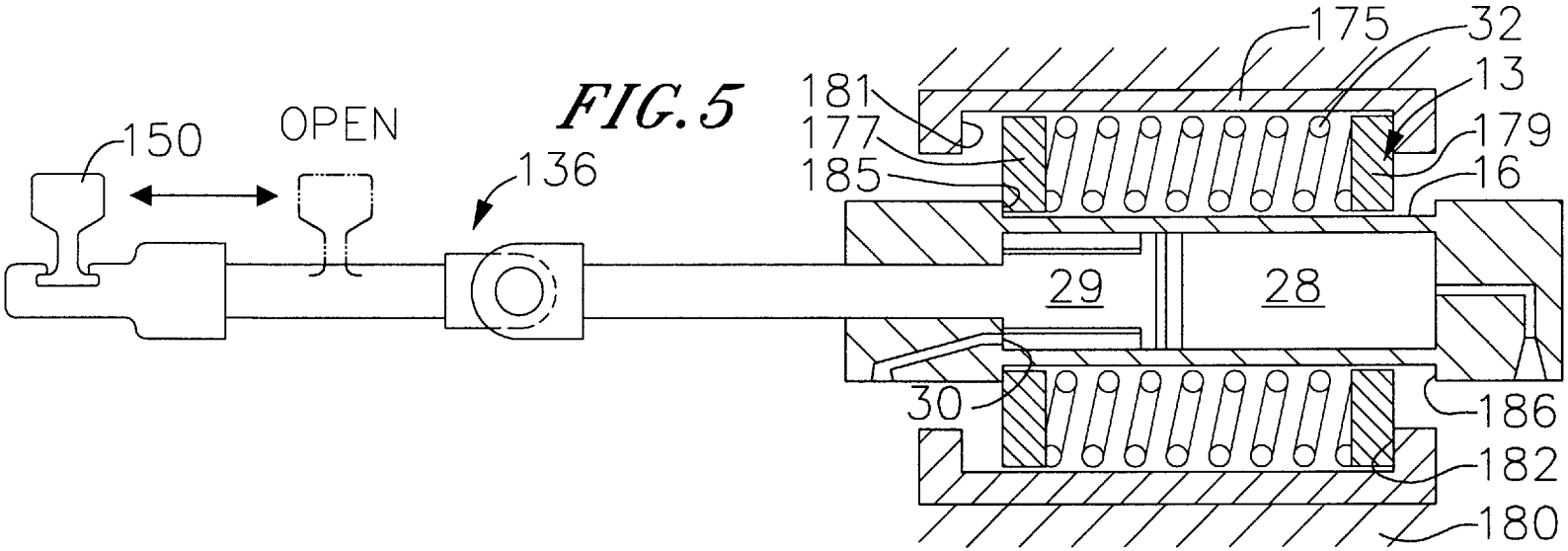
FIG. 5 is a side view, partly in half-section, of the hydraulic cylinder assembly and linkage of our invention attached to the moveable rails of a railroad switch.

With reference to FIG. 5 we show the adaptation of hydraulic cylinder assembly 13 and cylinder 16 to linkage 136. The linkage is the same as that shown in FIG. 4. The coupling of hydraulic cylinder to this linkage is suitable to move the moveable rails of a switch. We also illustrate spring 32 that positively acts on the linkage and through the linkage on the railroad switch moveable rails to stabilize them.

FIG. 5 also shows the detail of our spring pack or cylinder assembly 13. A mounting plate 175 receives spring 32. Retainers 177 and 179 confine the spring axially between them. The assembly of retainers, spring, and mounting plate is mounted in a base 180 and form the spring pack. The base in turn is mounted to ground. Mounting plate 175 has an interior shoulder 181. Cylinder 16 has a left external shoulder 185. Mounting plate 175 also has an interior shoulder 182. Retainers 177 and 279 can bear against shoulders 181 and 182, respectively. The retainers confine spring 32 axially between them. Cylinder 16 also has an external shoulder 186. As will become apparent from the description attending FIG. 6A, in the switch normal or away position, hydraulic fluid under pressure in chamber 28 acts on piston 29 and retainer 177 contacts shoulder 185 causing spring 32 to further compress.

Figures 6A, 6B, 6C, 6D:
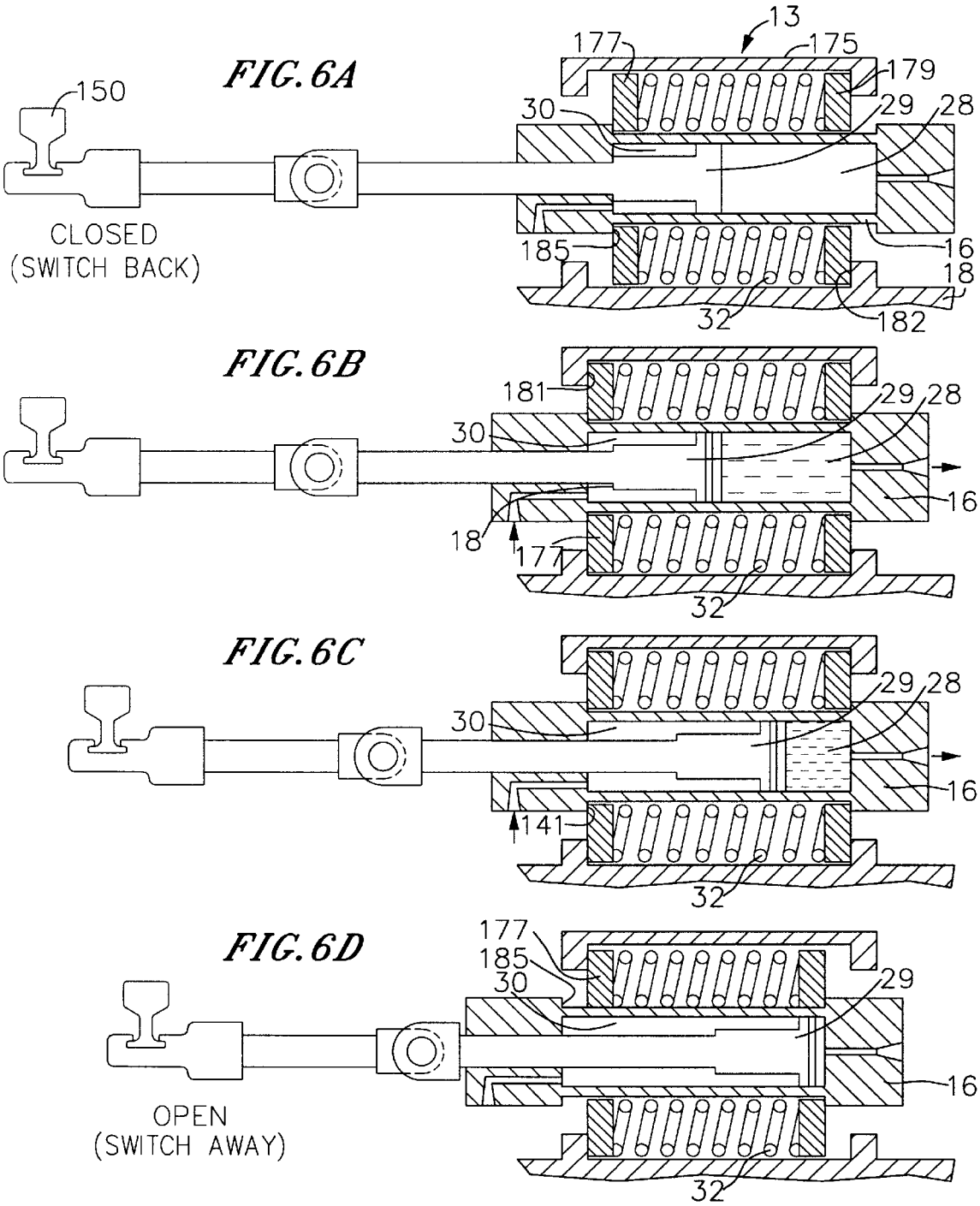
FIG. 6A is a schematic view of a hydraulic cylinder and power piston of the present invention attached through the linkage of FIG. 2 to a switch's moveable rail, and holding the moveable rail in the normal or away (closed) position with an interior spring of the cylinder holding the rail in contact with the mating rail.
FIG. 6B is a schematic view of a hydraulic cylinder and power piston of the present invention similar to FIG. 6A showing fluid beginning to enter the cylinder for opening the switch.
FIG. 6C is a schematic view similar to FIG. 6A–B the of a hydraulic cylinder assembly of the present invention showing further travel of the piston and of the railroad switch's moveable rails.
FIG. 6D is a schematic view similar to FIG. 6A–C of the hydraulic cylinder and power piston of the present invention showing the cylinder at completion of its move to the reverse or back position with the associated spring compressed to provide desirable rail closure forces.

FIG. 6B and 6C show the sequence of cylinder position after solenoid 24 is energized and the rail loses contact with the normal rail and moves towards contact with the reverse rail. When the railroad switch reverses, retainer 179 and shoulder 186 engage in the switch reverse position. The hydraulic pressure in chamber 30 transmits any forces acting from moveable rail 1, 3 to the right in FIG. 5 until rail closure occurs to spring 32 and through retainer 177 to ground. The cylinder permits travel in excess of that required to shift the rail. Excess travel compresses the spring.

The cylinder assembly and spring pack accommodates travel of the moveable rails during switching. When piston 29 sees hydraulic pressure in reverse chamber 30, the piston moves to the right in FIG. 5, and interior shoulder 185 bears firmly against retainer 177 and spring 32 resists movement. When piston 29 is to the left in the Figure, retainer 177 and external shoulder 185 of mounting plate 175 are in bearing, and switch closure forces from a train trailing through the switch are transmitted through the spring t to the base and to ground. (Thus, both by hydraulic fluid and the spring pack resist forces from trains trailing through the switch, and wear on the switch is low). Through the spring pack, we provide for cylinder travel greater than the track movement during switching.

With reference to FIGS. 6A through 6D, the operation of the hydraulic cylinder on the moveable rails of a railroad switch is evident. In FIG. 6A, the railroad switch is in the forward position. Hydraulic fluid in normal chamber 28 acts on piston 29 urging it to the left in the Figure and into the railroad switch normal position. The fluid in chamber 28 also acts on the right wall of the chamber which faces the piston. This force is to the right of the cylinder in FIG. 6A. Spring 32 acts on retainers 177 and 179. When a train trails through the switch, it applies a force through the piston and fluid in chamber 28 on the cylinder wall facing the top of the piston and tends to move cylinder 16 to the right in FIG. 6A. This tends to force shoulder 185 against retainer 177, and spring 32 resists because it acts through retainer 179 and interior shoulder 182 to ground. The hydraulic cylinder assembly stabilizes the moveable rails.

In FIG. 6B, piston 29 sees pressure in the reverse chamber 30. In this figure, hydraulic fluid from the accumulator side of the circuit begins entering reverse chamber 30, and piston 29 begins to translate to the right in its cylinder. Hydraulic fluid leaves normal chamber 28 as indicated by the arrow in FIG. 6B. Spring 32 forces retainer 177 against interior shoulder 181 of mounting plate 175.

In FIG. 6C, switching has progressed a little further with the piston forcing more hydraulic fluid from the normal chamber. In the Figure, the spring still keeps retainer 177 tightly against interior shoulder 181.

In FIG. 6D, reverse chamber 30 is completely full of hydraulic fluid. The fluid has forced piston 29 to the far right in its cylinder. Here, railroad switch 17 is in full reverse closure position. Note retainer 177 is off shoulder 185 and retainer 179 hears firmly against shoulder 186 of cylinder 16. Note also the travel of cylinder 16 relative to mounting plate 175 and the retainers 177 and 179 during switch opening.

We have already largely described the operation of our invention incident to the description of its physical components, and their relationships to one other. Accordingly, we will not have a prolonged description of the operation of our invention.

When an operator wants to open the railroad switch, switches 110, and 111 are operated. With the armature of switch 111 closed, motor 56 is in circuit and pump 52 pumps hydraulic fluid from reservoir 70 into accumulator 14 until normally closed accumulator pressure sensing pressure switch 93 opens, and the motor drops out of circuit.

With the armature of switch 110 on pole 110*a,* the operator from a remote location establishes a circuit to solenoid valve 24, which then opens and admits hydraulic fluid from the accumulator into normal chamber 28, and the railroad switch moves to closure in the normal position.

When the operator wants to reverse the railroad switch, the armature of switch 110 is moved to pole 110*b*. Solenoid valve 35 then opens, and normal chamber 30 receives hydraulic fluid and the switch moves to its reverse position.

When there is a sudden loss of pressure, pressure sensitive switch 93 closes, and pump 52 charges the accumulator. In the normal railroad switch position, normal chamber 28 sees the pressure controlled by pressure switch 27, and the switch is held in the normal closure position. In the reverse railroad switch position, reverse chamber 30 sees pressure controlled by pressure switch 33 and holds the switch in the full reverse position.

We have described the presently preferred embodiment of this invention with reference to the foregoing specification and drawings. The spirit and scope of the following claims should not necessarily, however, be limited to this description.

What is claimed is:

1. An improvement in a means for opening and closing a pair of moveable rails of a railroad switch between a closed and an open position, the improvement comprising:

(a) accumulator means for storing hydraulic fluid under pressure;

(b) means for charging the accumulator with hydraulic fluid at a predetermined pressure;

(c) a hydraulic cylinder having a reverse chamber, a forward chamber, and a piston dividing the two chambers, the reverse chamber corresponding to the switch closed position, the forward chamber corresponding to the switch open position;

(d) means for supplying the reverse chamber with hydraulic fluid from the accumulator to close the switch from the switch open position;

(e) means for supplying the forward chamber with hydraulic fluid from the accumulator to open the switch;

(f) linkage means to couple the piston to the moveable rails; and (g) the hydraulic cylinder has spring means for urging the cylinder in the direction of the switch closed position.

2. The improvement claimed in claim 1 wherein said spring means urges the piston in the direction of the reverse chamber to positively keep rail contact between the moveable rails and the fixed rail.

3. The improvement claimed in claim 2 including a housing receiving the spring means, and a pair of retainers in the housing axially constraining the spring means, the housing permitting retainer and spring travel greater than the movement betweqn open and closed switch positions.

4. The improvement claimed in claim 3 wherein the means for supplying hydraulic fluid to the hydraulic cylinder includes a reverse solenoid valve, and a forward solenoid valve for closing and opening the switch, respectively, the reverse solenoid valve being in hydraulic communication with the reverse chamber, the forward solenoid valve being in hydraulic communication with the forward chamber, both solenoid valves being in a hydraulic circuit with the accumulator.

5. The improvement claimed in claim 3 wherein the accumulator charging means includes a hydraulic pump and means to drive the hydraulic pump.

6. The improvement claimed in claim 4 wherein the accumulator charging means includes a hydraulic pump and means to drive the hydraulic pump.

7. The improvement claimed in claim 2 including an accumulator pressure sensing switch means for stopping charging of the accumulator when the accumulator pressure reaches a predetermined level.

8. The improvement claimed in claim 7 wherein the accumulator charging means includes a hydraulic pump and means to drive the hydraulic pump.

9. The improvement claimed in claim 7 including means to manually open and close the switch.

10. The improvement claimed in claim 2 including a reverse pressure sensing switch means for closing the reverse solenoid when the reverse chamber pressure reaches a predetermined value.

11. The improvement claimed in claim 10 including means to manually open and close the switch.

12. The improvement claimed in claim 10 wherein the accumulator charging means includes a hydraulic pump and means to drive the hydraulic pump.

13. The improvement claimed in claim 12 including a reverse solenoid valve, and a forward solenoid valve for opening and closing the switch respectively, the reverse solenoid valve being in a hydraulic circuit with the accumulator and the reverse chamber, the forward solenoid valve being in a hydraulic circuit with the accumulator and the forward chamber.

14. The improvement claimed in claim 2 including a forward pressure sensing switch means for closing the forward solenoid when the forward chamber pressure reaches a predetermined value.

15. The improvement claimed in claim 1 including a housing receiving the spring means, and a pair of retainers in the housing axially constraining the spring means, the housing permitting retainer and spring travel greater than track movement during switching.

16. The improvement claimed in claim 15 including:

(a) a reverse solenoid valve, and a forward solenoid valve for opening and closing the switch respectively, the reverse solenoid valve being in a hydraulic circuit with the accumulator and the reverse chamber, the forward solenoid valve being in a hydraulic circuit with the accumulator and the forward chamber;

(b) a reverse pressure sensing switch means for sensing the pressure in the forward chamber and which closes the reverse solenoid valve when the pressure in the forward chamber reaches a predetermined value;

(c) a forward pressure sensing switch means for sensing the pressure in the forward chamber, and which closes the forward solenoid valve when the pressure in the forward chamber reaches a predetermined value; and (d) an accumulator pressure sensing switch means for sensing pressure in the accumulator, and terminating accumulator charging at a predetermined accumulator pressure.

17. The improvement claimed in claim 1 including means to manually open and close the switch.

* * * * *